United States Patent [19]

Hawrylenko

[11] Patent Number: 4,923,305

[45] Date of Patent: May 8, 1990

[54] WATER BATH SHAKER

[75] Inventor: Alexander Hawrylenko, Bottmingen, Switzerland

[73] Assignee: Infors GmbH, Munich, Fed. Rep. of Germany

[21] Appl. No.: 232,469

[22] Filed: Aug. 15, 1988

[30] Foreign Application Priority Data

Aug. 13, 1987 [DE] Fed. Rep. of Germany ..... 3727010

[51] Int. Cl.[5] ..... B01F 11/00

[52] U.S. Cl. ..... 366/349; 366/118; 366/147; 366/288; 366/315; 366/347; 422/259; 134/157

[58] Field of Search ..... 366/315, 347, 349, 287, 366/288, 279, 276–278, 111, , 112, 117, 118, 147, 241, 243, 244, 245, 246, 247, 249–252; 422/258, 259, 38, 46, 62, 64, 300–302, 307; 134/140, 147, 149, 153, 154, 157, 158, 161, 201; 68/133; 237/19; 126/373–378, 387, 361; 122/13 R

[56] References Cited

U.S. PATENT DOCUMENTS

| | | | |
|---|---|---|---|
| 1,781,321 | 11/1930 | Dehuff | 366/288 |
| 2,203,135 | 6/1940 | Farrington | 366/288 |
| 2,646,807 | 7/1953 | Martin | 134/140 |
| 2,692,603 | 10/1954 | Foote | 134/140 |
| 3,110,627 | 11/1943 | Weiskopf et al. | 134/161 |
| 4,130,366 | 12/1978 | Braddyll et al. | 366/288 |
| 4,183,679 | 1/1980 | Kimmel | 366/288 |
| 4,599,003 | 7/1986 | Schiebelhuth et al. | 366/288 |

FOREIGN PATENT DOCUMENTS

| | | | |
|---|---|---|---|
| 63257 | 10/1982 | European Pat. Off. | 366/293 |
| 163056 | 10/1982 | Japan | 51/163.2 |

OTHER PUBLICATIONS

Microprocessor-Controlled Water Bath Shaker Gyrotory and Reciprocating Water Bath Shakers.

*Primary Examiner*—Harvey C. Hornsby
*Assistant Examiner*—Joseph S. Machuga
*Attorney, Agent, or Firm*—Antonelli, Terry & Wands

[57] ABSTRACT

A water bath shaker apparatus including a drive mechanism for producing a shaking motion and equipped with a tube for accommodating water, and a shelf having secured thereto a container of liquid to be shaken such as, for example, Erlenmeyer flasks. The tub has a filling zone for the water bath in the form of a closed ring with a central passage for the drive shaft of the drive mechanism, with the shelf being essentially constructed as a circular ring and being mounted at the upper end of the drive shaft so as to be driven by the drive shaft.

12 Claims, 1 Drawing Sheet

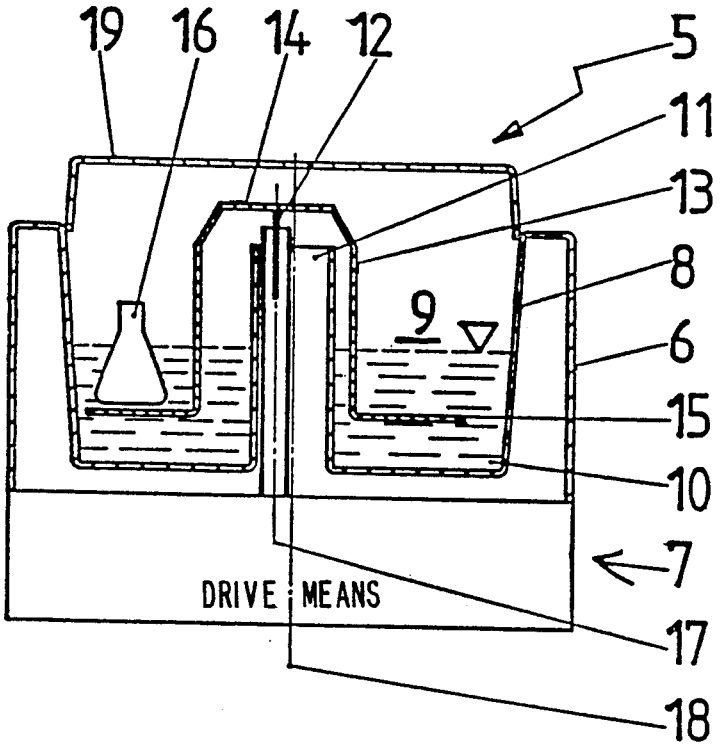
19
16
14
12
5
11
13
8
9
6
15
10
7
DRIVE MEANS
17
18

WATER BATH SHAKER

BACKGROUND OF THE INVENTION

The present invention relates to a water bath shaker apparatus and, more particularly, to a water bath shaker apparatus which includes a drive means for generating a shaking motion with a tub for accommodating the water of the water bath and with a shelf means disposed in the bath containing means for securing the container accommodating the liquid to be shaken, with the container being, for example, an Erlenmeyer flask.

Water bath shaker apparatus have been proposed which are of a considerable number of different designs. For example, in one proposed arrangement, a completely encapsulated drive mechanism is disposed in the water; however, a disadvantage of this proposed arrangement resides in the fact that corrosion occurs at the bearing sites. Moreover, the encapsulation of the drive mechanism renders the manufacturing of this proposed water bath shaker apparatus expensive, although the tube of the water bath can be covered entirely and securely by a lid for there is no significant heat loss which would normally occur with an open tub.

It has also been proposed to provide a water bath shaker apparatus wherein the shelf is driven from the outside by the drive means extending into the tube of the shaker apparatus. A disadvantage to this proposal resides in the fact that, although it is not as detailed as the aforementioned proposed water bath shaker apparatus, the shelf is not satisfactorily balanced and the tub of the water bath shaker apparatus can not be completely or easily covered.

The aim underlying the present invention essentially resides in providing a water bath shaker apparatus with a drive mechanism that is not only is simple in construction but is also considerably more balanced in such a manner that the tub of the water bath of the shaker apparatus can be completely covered.

In accordance with advantageous features of the present invention, a water bath of the aforementioned type is proposed which, in a surprisingly simple manner, includes a tub configured in the manner of a tube pan and, preferably, rotationally symmetrical, with the drive mechanism engaging in a central zone at a likewise rotationally symmetrical shelf. Consequently, the entire tub can be completely sealed by a lid in a maximally simple manner. Moreover, since the drive mechanism is not disposed in the water, not only are complicated gaskets or sealing means avoided but there is no possible corrosion at either the drive mechanism or associated bearing sites or locations.

Advantageously, in accordance with the present invention, the shelf is affixed to the drive shaft by a closed upside-down hollow cylinder means. Moreover, the shelf and hollow cylinder means are of a rotationally symmetrical structure.

The drive means of the present invention is adapted to produce a rotating shaking motion of the shelf, with the drive shaft executing an eccentric circular motion about an axis of symmetry of the tub in parallel to a longitudinally center axis of the drive shaft.

Furthermore, in accordance with the present invention, the drive shaft, during an eccentric circular rotation in one direction of rotation, revolves simultaneously about its own axis in another direction of rotation, with, as far as the amount is concerned, a respective number of revolutions being identical.

The above and other objects, features, and advantages of the present invention will become more apparent from the following description when taken in connection with the accompanying drawing which shows, for the purpose of illustration only, one embodiment in accordance with the present invention.

BRIEF DESCRIPTION OF THE DRAWING

The Single Figure of the drawing is a longitudinal cross sectional view of a water bath shaker apparatus constructed in accordance with the present invention.

DETAILED DESCRIPTION

Referring now to the Single Figure of the drawing, according to this figure, a water bath shaker apparatus generally designated by the reference numeral 5 comprises a housing 6 as well as a drive mechanism generally designated by the reference numeral 7 disposed in a bottom zone or area of the housing 6. The housing 6 includes a rotationally symmetrical tub 8, with a filling zone generally designated by the reference numeral 9 for the water 10, in the form of a closed ring with a central passage 11. A drive shaft 12 extends through the central passage 11 and, at the upper end of the drive shaft 12, a closed, upside-down hollow cylinder 13 is affixed thereto by an end face 14. A shelf 15 having in total, the structure or form of a circular ring adjoins the free end of the hollow cylinder 13. A securing means (not shown) secures a container such as, for example, an Erlenmeyer flask 16 on the shelf 15, with the flask 16 being adapted to be subjected to a rotating shaking motion executed by the shelf 15.

For this purpose, the drive shaft 12 executes an eccentric circular rotation about an axis of symmetry 18 of the tub 8 in parallel to a central longitudinal axis 17 of the drive shaft 12. At the same time, the drive shaft 12, during its eccentric circular motion in one direction of rotation revolves about its own axis 17 in the other direction of rotation, and with respect to the amount of rotation, a respectively identical number of revolutions are effected whereby the rotating shaking motion of the shelf 15 is produced. A lid 19 is provided for entirely covering the tub 8.

While I have shown and described only one embodiment in accordance with the present invention, it is understood that the same is not limited thereto but is susceptible to numerous modifications and changes known to one of ordinary skill in the art and I do not wish to be limited to the details described herein but only to the scope of the appended claims.

I claim:

1. A water bath shaker apparatus comprising a drive means for generating a shaking motion including a drive shaft means, a tub means for accommodating water of the water bath, a shelf means disposed in the water bath for securing a container means for accommodating a liquid to be shaken, said tub means comprising a filling zone for accommodating the water bath in the form of a closed ring with a central passage for accommodating the drive shaft means of the drive means, and wherein the shelf means is configured essentially as a circular ring mounted at an upper end of the drive shaft means and is driven by the drive shaft means is such a manner that the shelf means is subject to a rotating motion about an axis of symmetry of the shelf means and a shaking motion about an axis parallel to and spaced from the axis of symmetry.

2. An apparatus according to claim 1, further comprising lid means for sealing said tub means.

3. An apparatus according to one of claims 1 or 2, wherein the tub means is of a rotationally symmetrical structure.

4. An apparatus according to claim 3, wherein the shelf means is affixed to the drive shaft means by a closed upside-down hollow cylinder means.

5. An apparatus according to claim 4, wherein the shelf means and the hollow cylinder means are of a rotationally symmetrical structure.

6. An apparatus according to claims 3, further comprising lid means for sealing said tub means.

7. An apparatus according to one of claims 1 or 2 wherein said container means is an Erlenmeyer flasks.

8. A water bath shaker apparatus comprising a drive means for generating a shaking motion including a drive shaft means, a rotationally symmetrical tub means for accommodating water of the water bath, a rotationally symmetrical shelf means disposed in the water bath for securing a container means for accommodating a liquid to be shaken, said tub means comprising a filling zone for accommodating the water bath in the form of a closed ring with a central passage for the drive shaft means of the drive shaft, the shelf means is configured essentially as a circular ring and is affixed at an upper end of the drive shaft means by a rotationally symmetrical hollow shaft means and is driven by the drive shaft means in a rotating shaking motion, and wherein the drive shaft means executes an eccentric circular motion about an axis of symmetry of the tub means in parallel to a longitudinal center axis of said drive shaft means.

9. an apparatus according to claim 8, wherein the drive shaft means, during the eccentric circular motion in one direction or rotation, revolves simultaneously about it own axis in an opposite direction of rotation, with the number of revolutions, respectively, being identical.

10. An apparatus according to one of claims 8 or 11, further comprising lid means for sealing said tub means.

11. A water bath shaker apparatus for generating a shaking motion including a drive shaft means, a tub means for accomodating water of the water bath, a shelf means disposed in the water bath for securing a container means for accommodating a liquid to be shaken, said tub means comprising a filling zone for accommodating the water bath in the form of a closed ring with a central passages for the drive shaft means of the drive means, the shelf means is configured essentially as a circular ring mounted at an upper end of the drive shaft means and is driven by the drive shaft means, and wherein the drive shaft means executes an eccentric circular motion about an axis of symmetry of the tub means in parallel to a longitudinal center axis of said drive shaft means.

12. An apparatus according to claim 11 wherein the drive shaft means, during the eccentric circular motion in one direction of rotation, revolves simultaneously about its own axis in an opposite direction of rotation, with the number of revolutions, respectively, being identical.

* * * * *